United States Patent [19]

Larson

[11] 4,278,118

[45] Jul. 14, 1981

[54] LOG SPLITTER FOR GARDEN TRACTORS

[76] Inventor: Dennis L. Larson, 8547 Hyde Ave. South, Cottage Grove, Minn. 55016

[21] Appl. No.: 54,802

[22] Filed: Jul. 5, 1979

Related U.S. Application Data

[63] Continuation of Ser. No. 914,667, Jun. 9, 1978, abandoned.

[51] Int. Cl.[3] ..... B27L 7/00

[52] U.S. Cl. ..... 144/193 A; 180/53 FE

[58] Field of Search ..... 74/13, 15, 15.6, 15.69; 180/53 WA, 53 C, 53 FE; 144/193 R, 193 A

[56] References Cited

U.S. PATENT DOCUMENTS

| | | | |
|---|---|---|---|
| 2,490,698 | 12/1945 | McClenny | 180/53 C |
| 2,758,555 | 8/1956 | Buhr | 180/53 WA |
| 3,077,214 | 2/1963 | Brukner | 144/193 A |
| 3,319,675 | 5/1967 | Bles, Sr. | 144/193 A |
| 3,356,115 | 12/1967 | Cole | 144/193 A |
| 3,640,323 | 2/1972 | Helle | 144/193 A |
| 3,779,295 | 12/1973 | Balsbaugh | 144/193 A |
| 4,027,709 | 6/1977 | Thackery | 144/193 R |
| 4,076,062 | 2/1978 | Kanik | 144/193 A |

*Primary Examiner*—W. D. Bray

*Attorney, Agent, or Firm*—Kinney, Lange, Braddock, Westman and Fairbairn

[57] ABSTRACT

The present invention relates to a log splitting apparatus utilizing a hydraulic cylinder mounted onto a main frame member and having a movable pusher portion that forces log sections against an upright cutting blade. The main frame member is tubular and also forms the hydraulic reservoir for the hydraulic system used with the cylinder. The entire splitter assembly is mounted onto mounting brackets which permit the splitter assembly to be placed onto a graden tractor with the axis of the power cylinder crossways to the longitudinal (fore and aft) axis of the garden tractor for compact assembly. The splitter assembly is self-contained and is powered directly from the power take-off of such garden tractor.

4 Claims, 4 Drawing Figures

LOG SPLITTER FOR GARDEN TRACTORS

This is a continuation of application Ser. No. 914,667, filed June 9, 1978 and now abandoned.

BACKGROUND OF THE INVENTION

1. Field of the Invention

The present invention relates to a log splitter attachment mounted directly onto garden tractors.

2. Prior Art

U.S. Pat. No. 3,356,115 illustrates a log splitter that is mounted onto a trailer frame and is pulled behind a vehicle. The use of log splitters on such trailing vehicles has been known, and such trailing vehicles are powered by a power source which may include the towing vehicle. A typical log splitter is also shown in U.S. Pat. No. 3,319,675, and it is shown that the head 56 for pushing the log is tilted relative to the axis of movement, so that the log is forced into the blade as the blade is pushed against the log resting on this head. Additional patents which show the state of the art are U.S. Pat. Nos. 3,077,214, 3,640,323, and 4,027,709.

Further, it is known in the prior art to use tubular frame members for storing hydraulic fluid in devices such as hydraulic loaders, but in making a log splitter where a heavy frame is required, the hydraulic system and power unit are generally kept completely separate from the frame.

SUMMARY OF THE INVENTION

The present invention relates to a hydraulic actuated self-contained log splitter assembly that can be mounted onto a garden tractor, and which will utilize the garden tractor power take-off for powering the hydraulic system used for the log splitter. The log splitter comprises an elongated main frame or backbone member positioned with its longitudinal axis transverse to the fore and aft axis of the tractor. The assembly includes mounting means for supporting the frame member directly on the garden tractor in position either immediately ahead of the front or immediately behind the rear of the tractor through suitable brackets. The elongated frame has a stationary upright cutting blade at one end thereof, and at the opposite end of the frame the base end of a hydraulic cylinder assembly is mounted. The rod of the hydraulic cylinder carries a pusher head or plate that is guided on a suitable guide portion of the longitudinal frame. The cylinder rod may be reciprocated under hydraulic pressure between a retracted and an extended position. Upon actuation of the cylinder the pusher will push a log positioned between the pusher in its retracted position and the cutting blade against the cutting blade causing the log to be split.

The hydraulic system is supported on the main frame member, and includes a pump valve, which is carried as a complete package with the frame. The pump is adapted to be powered from the power take-off of the garden tractor. The mounting of the splitter at the front or rear of the garden tractor depends on whether the power take-off is front or rear, and also depends somewhat on the individual configuration of the garden tractor being utilized.

An important feature of the present device is that the main frame member is a tubular enclosed member that forms the reservoir for hydraulic fluid for the hydraulic system. Additionally, the guide member for the pusher is wide to provide a support for the log sections to be split, and the blade of the unit is inclined so that as log sections are forced against the cutting blade they tend to be forced downwardly toward the main frame.

The mounting brackets which attach to the garden tractor are designed to be an integral part of the splitter unit to make a very compact device for splitting logs with the power actuation axis transverse to the fore and aft of the garden tractor to make the entire unit very compact. Because it is self-contained, it is easily attached, and does not take a great deal of space for storage.

DESCRIPTION OF THE PREFERRED EMBODIMENT

Figure 1:
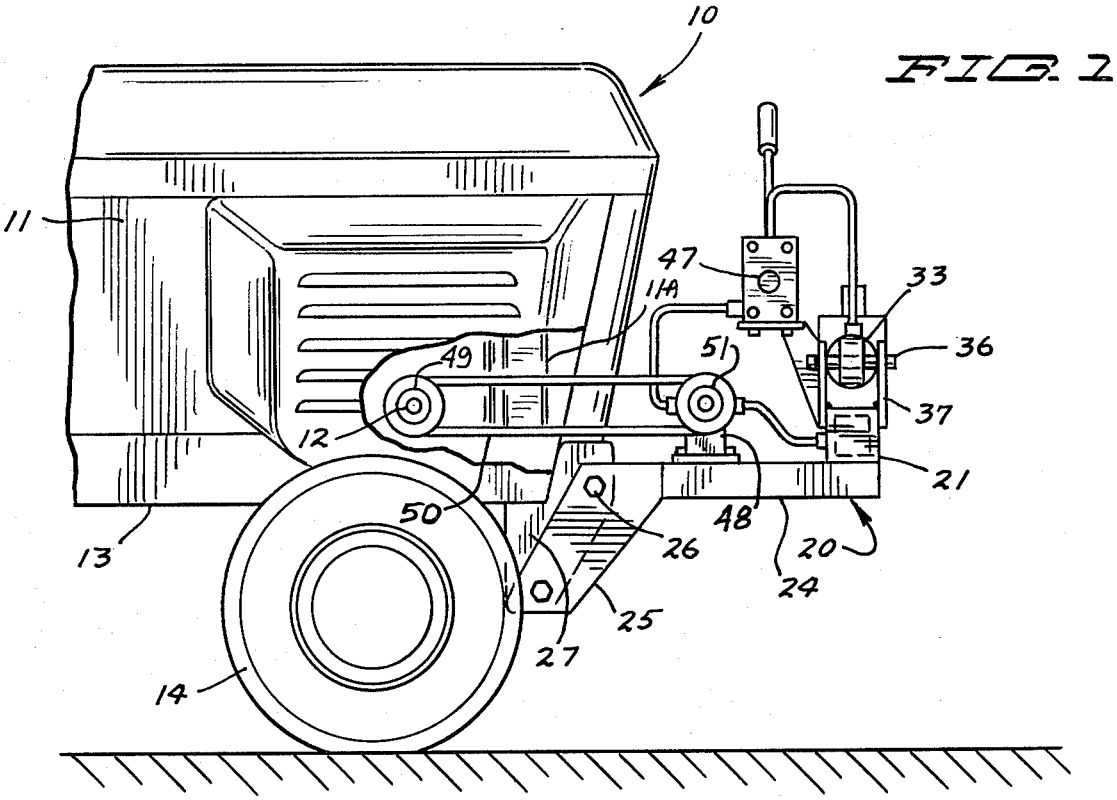
FIG. 1 is a fragmentary side elevational view of a portion of a typical garden tractor showing a log splitter made according to the present invention installed thereon.

Referring to the drawings, a garden tractor indicated generally at 10 is of usual design and includes an engine compartment 11 housing an engine shown partially at 11A which has a power take-off shaft 12. As shown, the frame 13 of the tractor is supported with respect to the ground through front and rear wheels 14, and of course the tractor itself is steerable in the usual manner.

A log splitter of the present invention illustrated generally at 20 includes a main elongated frame member 21, which as shown extends transversely to the fore and aft axis of the tractor, (see FIG. 3) which axis is indicated at 22. The transverse main frame member is mounted onto support brackets 24, which in turn are connected to attachment brackets 25 mounted through suitable pins or bolts 26 to the mounting pads 27 of a typical garden tractor at the forward portion of the tractor. The elongated main frame member 21, as shown, extends outwardly beyond the side edges of the garden tractor on both sides of the tractor. Most garden tractors include mounting pads or means of some type for auxiliary devices such as mowers.

Adjacent one end of the frame member 21 an upright splitting wedge or blade 30 is fixedly mounted. The blade 30 has a sharpened upright edge 31 thereon. This sharpened edge 31 faces a hydraulic cylinder assembly 32. The cylinder assembly 32 includes a cylinder member 33 having a rod 34 which is actuated (extended and retracted) by an internal piston (not shown) to move a splitter head 35. The base end of the cylinder 33 is mounted with a pin 36 to upright brackets 37 which in turn are fixed to the frame member 21. The splitter head or pusher 35 includes guideway receiving members 39.

Figure 2:
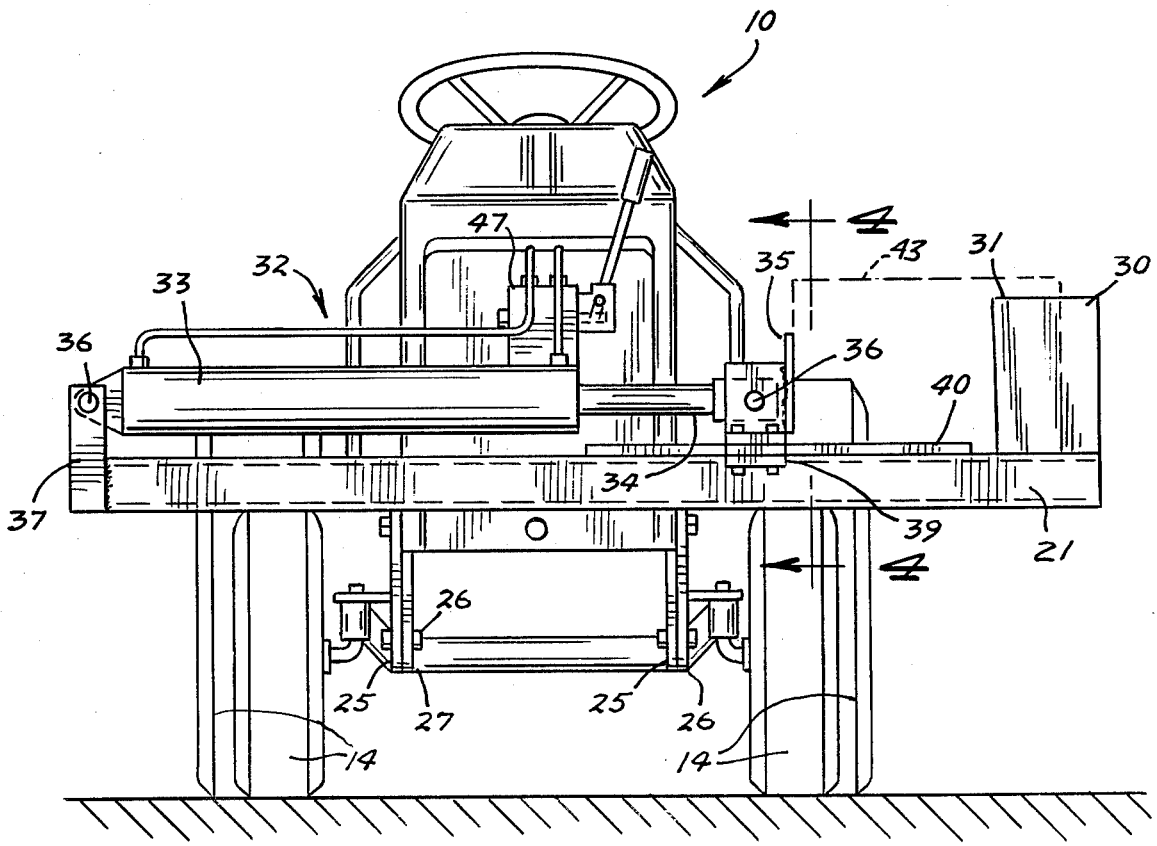
FIG. 2 is a front elevational view of the device of FIG. 1.
Figure 3:
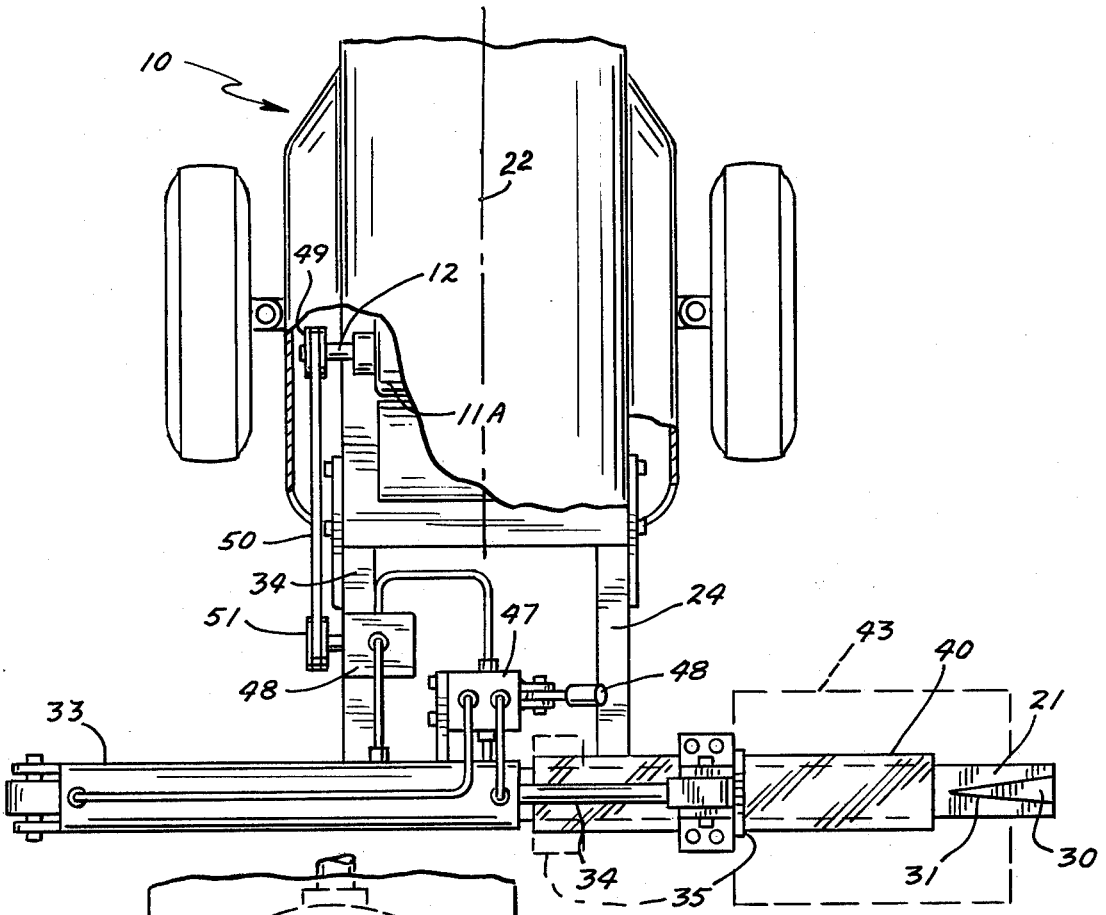
FIG. 3 is a top plan view of the forward portions of the device of FIG. 1 with parts in section and parts broken away.

The guideway receiving members 39,39 receive opposite side edge portions of a guideway and support plate 40 that is mounted to the upper surface of the main frame member 21. This guideway plate 40 as can be seen in FIGS. 2 and 3, extends along the frame member 21 a suitable distance and forms the area into which a log section would be placed when the head is fully retracted as shown in its dotted line position in FIG. 3. A log section which has been partially split is indicated in dotted lines at 43.

The hydraulic cylinder assembly 32 is a double acting cylinder, and is controlled through a valve 47 that has a control handle as shown, and in turn fluid under pressure is supplied from a pump indicated generally at 48 which is powered through a pulley 49 mounted onto the power take-off shaft 12 of the tractor, which in turn drives the belt or suitable drive member 50 to drive another pulley 51 on the input shaft of the pump 48. The pump itself is mounted onto the brackets 24 so that the splitter assembly is a self-contained unit, and when the mounting brackets 25 are placed onto the mounting pads of the tractor, the only connection that needs to be made is the belt 50.

Figure 4:
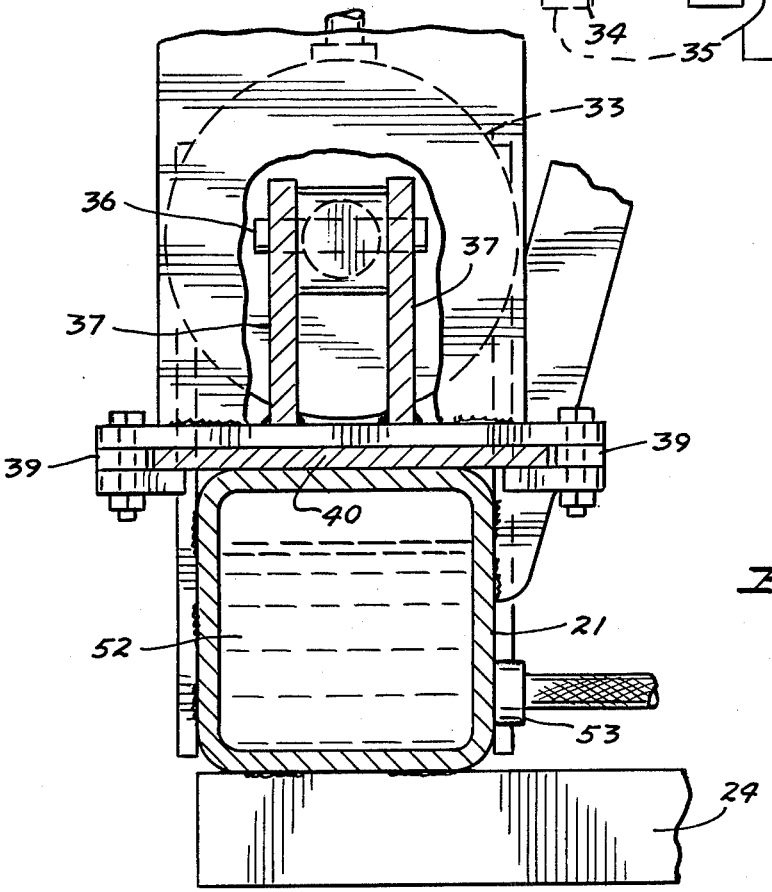
FIG. 4 is a sectional view taken as on line 4—4 in FIG. 2.

It should be noted, and it can be seen in FIG. 4 in particular, that the frame member 21 is a square tube frame in cross section, and this tube is closed at its ends to form an interior reservoir chamber 52 to contain hydraulic fluid. Suitable connections as indicated for example at 53 are made to permit the pump to withdraw hydraulic fluid from the reservoir and connection is made from the valve 48 back to the reservoir for return fluid.

In operation, the log 43 which is shown in dotted lines is placed on the support or pad 40, in position so that it is between the cutting edge 31 of the upright member 30 and the pusher head 35. Then the lever 48 is operated to control fluid under pressure to the base end of the cylinder 33 forcing the rod 34 outwardly and forcing the log section against the cutting edge and thereby splitting it. The guide plate 40 provides an adequate support of the log section and adequate guide for the pusher member and plate so that there isn't excessive wear. The power from the hydraulic cylinder is easily supplied from the power take-off of the tractor.

It can of course be seen that the tractor itself can be driven to any desired location for operation. A very compact unit is made by having the main frame member 21 positioned transverse to the fore and aft axis 22, and by using the frame tube for the hydraulic reservoir. The line or axis of operation of the cylinder is also transverse to the longitudinal axis of the tractor to provide for great compactness, and to eliminate the need for any trailing devices or trailers.

It should be noted that the brackets 24,24 can be adapted for mounting onto rear mounting pads or brackets at the rear axle of a typical garden tractor. The shaft for the pump 48 can be driven from a rear power take-off if desired.

The cutting edge 31 of the splitting member 30 is inclined at an included angle that is less than 90° as measured or seen in FIG. 2 with respect to the upper surface of the guide member 40. It can be seen therefore that as the splitting occurs a downward component of force is created because of the action tending to force the log against the frame and guide member 40. Thus there is no substantial problem with the log popping out when it is under splitting force.

Compactness, ease of operation, and convenience by having a mobile log splitter is apparent. The use of the frame member 21 for both the main backbone or support of the unit and the hydraulic reservoir, simplifies the structure and saves space as well.

What is claimed is:

1. A self contained log section splitter attachment for a self propelled garden tractor having a tractor support frame extending in fore and aft direction with wheel means for supporting said tractor frame and an engine for normally powering the garden tractor, and including a power take off means, said attachment being mountable and removable from a garden tractor as a unit and comprising a generally horizontal elongated main frame member, support means comprising a pair of spaced plates fixed to the main frame member, said plates being positioned on opposite sides of a tractor support frame on which the attachment is mounted and attached thereto, said support means mounting said main frame in position extending transverse to the fore and aft direction of said garden tractor support frame and to the direction of normal movement of the garden tractor, said support means positioning the main frame so that the ends of the main frame extend laterally beyond both sides of the garden tractor, a splitting wedge fixedly mounted adjacent a first end of said main frame member, hydraulic cylinder means mounted on said generally horizontal main frame member on an opposite end thereof from said splitting wedge, said hydraulic cylinder means including a movable portion operable under hydraulic pressure and movable toward and away from said splitting wedge, plate means on the upper side of the main frame member forming a support for log sections to be split between said splitting wedge and said hydraulic cylinder means, said plate means forming a support comprising a plate having side edge portions extending outwardly beyond the side edges of other portions of said main frame member on both sides thereof, the side edge portions of said plate means forming guide members extending in direction of movement of said movable portion of said hydraulic cylinder means, said movable portion having guideway receiving members slidably mounted over and guided by the side edge portions of said plate means, means mounted in the center portion of said main frame member between the sides of a garden tractor on which it is mounted comprising a hydraulic valve and hydraulic pump operable to operate said hydraulic cylinder to force a log section on the support means against said cutting wedge, means forming a hydraulic fluid reservoir carried by said support means for connection to the hydraulic pump and valve, and drive means operable between the power take off of a garden tractor on which the log section splitter attachment is mounted and said hydraulic pump to drive said pump.

2. The combination as specified in claim 1 wherein said main frame member comprises an elongated tubular member forming a chamber in its interior comprising a hydraulic fluid reservoir for said hydraulic means.

3. The log splitter attachment of claim 1, wherein said means forming a hydraulic fluid reservoir comprises at least a portion of the main frame formed into a tubular section extending longitudinally along the longitudinal axis of the main frame, said plate means being attached to said tubular section.

4. The combination as specified in claim 1 wherein said hydraulic cylinder includes an actuable rod extendable and retractable from said cylinder, the axis of actuation of said rod being transverse to the fore and aft axis of said garden tractor.

* * * * *